US010638790B2

(12) United States Patent
Grant et al.

(10) Patent No.: US 10,638,790 B2
(45) Date of Patent: May 5, 2020

(54) METHOD AND APPARATUS FOR INTERMEDIATELY STORING DOUBLE-LENGTH SEMI-FINISHED PRODUCTS

(71) Applicant: PHILIP MORRIS PRODUCTS S.A., Neuchatel (CH)

(72) Inventors: Christopher John Grant, Neuchatel (CH); Pierre-Yves Gindrat, Saxon (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/502,542

(22) PCT Filed: Sep. 17, 2015

(86) PCT No.: PCT/EP2015/071370

§ 371 (c)(1),
(2) Date: Feb. 8, 2017

(87) PCT Pub. No.: WO2016/042101

PCT Pub. Date: Mar. 24, 2016

(65) Prior Publication Data

US 2017/0238600 A1 Aug. 24, 2017

(30) Foreign Application Priority Data

Sep. 19, 2014 (EP) ..... 14185602

(51) Int. Cl.
*A24C 5/35* (2006.01)
*A24C 5/47* (2006.01)
*A24F 47/00* (2020.01)

(52) U.S. Cl.
CPC ..... *A24C 5/35* (2013.01); *A24C 5/478* (2013.01); *A24F 47/006* (2013.01)

(58) Field of Classification Search
None
See application file for complete search history.

(56) References Cited

U.S. PATENT DOCUMENTS 4,872,543 A * 10/1989 Hinchcliffe ..... A24C 5/35 198/347.3
5,220,992 A * 6/1993 Milins ..... A24C 5/325 131/282

(Continued)

FOREIGN PATENT DOCUMENTS

CN 1291082 4/2001
CN 1446734 10/2003

(Continued)

OTHER PUBLICATIONS

PCT Search Report and Written Opinion for PCT/EP2015/071370 dated Dec. 1, 2015 (13 pages).

*Primary Examiner* — Eric Yaary
(74) *Attorney, Agent, or Firm* — Mueting, Raasch & Gebhardt, P.A.

(57) ABSTRACT

The method for intermediately storing double-length substantially cylindrical semi-finished products comprises the step of providing a tipping apparatus and forming double-length substantially cylindrical semi-finished products in the tipping apparatus. The method further comprises the steps of providing a cutting device and cutting the double-length semi-finished product into single products with the cutting device and providing a packer and packing single products in the packer. The method yet further comprises the steps of transporting the double-length semi-finished products from the tipping apparatus to the cutting device and transporting the single products from the cutting device to the packer, and intermediately buffering double-length substantially cylin- (Continued)

drical semi-finished products in a buffer arranged between the tipping apparatus and the cutting device.

15 Claims, 2 Drawing Sheets

(56) References Cited

U.S. PATENT DOCUMENTS

| | | | |
|---|---|---|---|
| 5,833,045 | A | 11/1998 | Osti |
| 6,318,540 | B1 | 11/2001 | Spatafora |
| 6,422,380 | B1 | 7/2002 | Sikora |
| 6,793,062 | B2 | 9/2004 | Hammock |
| 7,117,872 | B2 | 10/2006 | Draghetti |
| 2012/0125737 | A1 | 5/2012 | Figarski |

FOREIGN PATENT DOCUMENTS

| | | | | |
|---|---|---|---|---|
| CN | 1917784 | | 2/2007 | |
| CN | 101019690 | | 8/2007 | |
| CN | 201523661 | | 7/2010 | |
| CN | 202958787 | | 6/2013 | |
| DE | 1725250 | | 6/1956 | |
| DE | 1127778 | | 4/1962 | |
| DE | 2348597 | | 9/1982 | |
| EP | 1346651 | | 9/2003 | |
| EP | 1715766 | | 3/2009 | |
| EP | 2230951 | | 3/2012 | |
| GB | 1301843 | | 1/1973 | |
| GB | 1352631 | | 5/1974 | |
| GB | 1 584 551 | | 2/1981 | |
| GB | 2259847 | | 3/1993 | |
| GB | 2296000 | | 7/1999 | |
| JP | 52-125699 | | 10/1977 | |
| JP | 63-022414 | | 2/1988 | |
| RU | 2229831 | | 6/2004 | |
| RU | 2482779 | | 5/2013 | |
| WO | WO 97/19605 | | 6/1997 | |
| WO | WO 2013/120565 | | 8/2013 | |
| WO | WO-2013120566 | A2 * | 8/2013 | ..... A24D 3/048 |
| WO | WO 2013/164124 | | 11/2013 | |
| WO | WO 2013/190036 | | 12/2013 | |

* cited by examiner

METHOD AND APPARATUS FOR INTERMEDIATELY STORING DOUBLE-LENGTH SEMI-FINISHED PRODUCTS

This application is a U.S. National Stage Application of International Application No. PCT/EP2015/071370, filed Sep. 17, 2015, which was published in English on Mar. 24, 2016 as International Publication No. WO 2016/042101 A1. International Application No. PCT/EP2015/071370 claims priority to European Application No. 14185602.1 filed Sep. 19, 2014.

The invention relates to a method and apparatus for intermediately storing double-length semi-finished products. Especially, it relates to an apparatus and method for manufacturing double-length semi-finished products and intermediately storing the double-length semi-finished products before manufacturing and packing single products. Preferably, the single products are aerosol-generating articles such as for example, smoking articles.

The handling of rod-shaped consumer goods can present a number of challenges in a high-speed manufacturing process. For example, aerosol-generating articles, such as filter cigarettes, are typically made from at least two cylindrical objects, for example a tobacco rod and a filter. During the manufacture of aerosol-generating articles, such as filter cigarettes, the two cylindrical objects are joined during a rolling process with a tipping paper. The tipping paper creates a small step-change between the circumference of the first cylindrical object and the second cylindrical object. This step creates an angle between the edge of the tipping paper and the free edge of the second cylindrical object. While the angle is generally small, however, during production, many of the finished aerosol generating articles may be stacked up on top of each other in a mass-flow or a hopper and the cumulative effect of each small angle may create a significant total angle at the top of the stack. This may cause the aerosol generating articles to jam in the mass-flow or hopper, particularly since a mass-flow production process allows a certain degree of free movement of the aerosol-generating articles. The effect depends on the size of the step created by the tipping paper and the length of the product between the free edge of the second cylindrical object and the tipping paper. The risk of jams is further increased when the product has an uneven mass distribution, in particular where the center of mass of the article is in the section of the article with the smaller diameter. The effect increases further where the section of the article with the smaller diameter is ductile and therefore, where articles are stacked onto each other, may sink into adjacent articles due to gravitational forces, thus increasing the nesting of the articles on one side and in turn adding to the stacking angle.

There is therefore a need for methods and apparatus that can handle mass-flow of short and ductile substantially cylindrical objects, in particular between a making section and a packaging section of the manufacturing process.

According to a first aspect of the present invention, there is provided a method for intermediately storing double-length substantially cylindrical semi-finished products. The method comprises the steps of providing a tipping apparatus and forming double-length substantially cylindrical semi-finished products in the tipping apparatus. The method further comprises the steps of providing a cutting device and cutting the semi-finished product into single products with the cutting device and providing a packer and packing single products in the packer. The method yet further comprises the steps of transporting the semi-finished products from the tipping apparatus to the cutting device and transporting the single products from the cutting device to the packer, and intermediately buffering double-length substantially cylindrical semi-finished products in a buffer arranged between the tipping apparatus and the cutting device.

Double-length semi-finished products may be temporarily stored in the buffer before being transported to the cutting device. The buffer may be regarded as a loop, preferably of varying size, in the transport system. The buffer is a mass-flow system. This may for example be a tray system, where the double-length semi-finished products are loaded into a tray and then at a later stage put back into the processing flow of the transport system. Preferably, the buffer is part of the transport system such that double-length semi-finished products are always guided into and through the buffer. Such an inline buffer has the advantage that it may immediately react on a reduced input or output rate. It further has the advantage that an input-output order of the products into and out of the buffer may be defined (for example, first in—first out or last in—first out) within the precision that is intrinsic in a mass-flow. In addition, with an inline buffer the entire production may be kept at same environmental conditions such that changes in environmental conditions onto the manufactured products may be kept substantially constant as opposed to a tray system.

If an output rate of the buffer is lower than an input rate, for example, due to a slow-down or interruption of the cutting, turning or packing of products downstream of the buffer, the buffer is filled with double-length semi-finished products. If an input rate falls below the output rate, buffered double-length semi-finished product are provided from the buffer to the cutting device without having to slow down or shut down the manufacturing of single products.

In the buffer, the double-length semi-finished products are processed according to a mass-product flow. A mass-flow of products requires less space than an individual product flow. However, a mass-flow is not precise. For example, a localization of each product in the mass-flow is not available in a mass-product flow. In a mass-flow the products are transported along a general moving direction. In a mass-flow an individual product has some degree of freedom for random movement relative to the general transport direction, for example upwards or downwards where the general transport direction is horizontal. Thus an exact position of the individual products in the mass-flow is not known. Additionally, the individual velocity of a product along the general transport direction does not have to be equal to the average transport speed of products within the mass-flow. Where individual handling of the products is required, the products are handled according to an individual product flow. For example, in the tipping apparatus or in the cutting device, the products are processed according to an individual product flow. In an individual product flow, control over an individual product is given at any stage in a manufacturing and processing line. For example, the position and alignment of the product is known at any time. This allows, for example, to provide a single discharge device at one location in the processing line only. Detection means to detect objects not fulfilling specification requirements may, for example, be arranged along the entire processing line. Due to the individual product flow, the objects to be disposed of may be virtually marked and disposed of further downstream by the discharge device. To convert the mass-flow into an individual flow, a flow conversion unit is arranged between according process units, for example a hopper.

By arranging a buffer downstream of the tipping apparatus, double-length semi-finished products may be intermediately stored. Especially, semi-finished products may be continuously produced in the tipping apparatus and temporarily stored. For example, a shut down or slowdown of the tipping apparatus or parts thereof may at least temporarily be avoided, when a downstream end of the manufacturing process is interrupted, for example a cutting, turning or packing of products. It also allows to continuously manufacture and pack single products even when a manufacturing process or the preparation of semi-finished products in the tipping apparatus is interrupted.

As used herein, the terms 'upstream' and 'downstream' when used to describe the relative positions of elements, or portions of elements, of the transport unit or other apparatus refer to the direction in which the plurality of semi-finished products or single products moves during the manufacturing and transporting process. That is, semi-finished products move in a downstream direction from an upstream end to a downstream end. Downstream end and upstream end or proximal end and distal end are also used to describe the orientation of the semi-finished products or single products and the direction in which a user draws on the single product. In a single product corresponding to aerosol-generating products comprising an aerosol-forming substrate and a mouthpiece, the mouthpiece corresponds to a downstream end of the single product and the aerosol-forming substrate corresponds to an upstream end of the single product. Accordingly, a user draws on the downstream end of the aerosol-generating article so that air enters the upstream end of the aerosol-generating article and moves downstream to the downstream end.

Providing a buffer for semi-finished products has the further advantage that single products may be packed directly after cutting such that no storing of single products is required. Storing of semi-finished products is more convenient since the products are longer than single products and are therefore easier to be aligned and kept aligned. Semi-finished products may, for example, be kept in a stacked arrangement in the buffer.

While a smoking article such as a conventional cigarette is substantially homogeneous, especially in weight, an aerosol-forming article may be inhomogeneous, especially in the distribution of weight, due to the different segments the aerosol-forming article is combined of. For example, a tobacco plug is a segment with a higher density compared to for example a filter segment or a cavity and is in addition typically arranged at a distal end of the single product. Thus, the single product has a center of mass, which is shifted from the midpoint at half length of the single product to the distal end thereof. Therefore, such a single product may tend to tilt when being transported or stored in mass flow.

A tilting of a single product may also be caused upon stacking the single products. As outlined above, aerosol-generating products are typically made from several cylindrical segments. During the manufacture of the single product, segments are joined with a tipping wrapper. The tipping wrapper covers a proximal portion of the single product and extends over a portion of the length of the single product. The tipping wrapper creates a little step between the circumference at the proximal portion and the distal portion. This step creates an angle between the edge of the tipping wrapper and the distal end of the single product. This stacking angle is very small. However, during production, many products are stacked up on top of each other in a mass-flow or a hopper. Thus, the angle stacks up and may cause a stack of products to tilt. Such a tilting may cause a jam in a mass-flow or a hopper. The effect depends on the size of the step created by the tipping wrapper and the length of the product between the distal end and the tipping wrapper. Thus, for aerosol-generating articles with a small diameter this effect is further enhanced. In addition, thick tipping paper used in the manufacture of aerosol-generating products may further increase the step size. As mentioned above, due to the uneven weight distribution the danger of jams is further increased when the product has an uneven mass distribution, in particular, where the center of mass of the article is on the side of the article with the smaller diameter, as may often be the case with aerosol-generating products having a tobacco plug at a distal end of the single product.

The effect grows even further where the side of the article with the smaller diameter is ductile. When articles are stacked onto each other, the ductile parts may sink into adjacent products due to gravitational forces. Thus the nesting of the articles on one side is increased, which in turn adds to the stacking angle.

In double-length semi-finished products such an unbalance when seen over the entire length of the semi-finished product is reduced or completely avoided. Double-length semi-finished products are symmetric with respect to the midpoint at half length. Thus, the double product is symmetric right and left to a midpoint and has the center of mass in the center of the double-product. Further, the stacking angle of such a double-product is substantially zero degrees. Thus, there exists no unbalance of one end of the double-length semi-finished product versus the other end of the semi-finished product. Tilting and nesting of products may thus substantially be avoided such that also the risk of jamming may significantly be reduced or completely be avoided.

The method according to the present invention can reduce undesirable compression of single products and semi-finished products at the bottom of a stack. This is particularly advantageous when handling single products that may comprise a step change in the diameter of each single product along the length of the product. In particular, reducing the gravitational forces acting along the stack of products can reduce the cumulative stacking angle effect described above, which might otherwise cause a jam in a mass-flow. This positive effect is further increased for rod-shaped products where the section with the tipping paper is relatively stiff as compared to other parts of the product. According to the invention, the gravitational forces that act on the double-product are centered around the stiffer section with tipping paper, forming the principle contact point between stacked double-products and thereby reducing crushing forces on sections of the product that are more ductile.

Cutting the double-length semi-finished product only immediately before the single product is packed additionally has the advantage that the not-yet cut segments (then forming ends of the cut products) are still at least partly protected from mechanical and environmental influences, for example, the mouth end filter section of such a product.

In the method according to the invention, double-length semi-finished products manufactured in the tipping apparatus may online be fed into the buffer, from where they may again online be transported to the cutting device and further to the packer. Since the products in the buffer are proceeded in in a mass-flow, a conversion unit is preferably arranged between the buffer and the cutting device, to convert the mass-flow into an individual flow. A conversion unit to achieve such a conversion from a mass-flow to an individual floe may for example be a hopper.

According to an aspect of the method according to the invention, the step of packing single products directly follows the step of cutting the double-length semi-finished products. Preferably, these two steps are performed directly after each other. Optionally, these two steps are separated only by a step of orienting the single products in a same orientation. Due to the presence of a buffer arranged upstream of the cutting device, that is, upstream of the production location of single products, preferably, the single products are packed shortly after being cut. According to one embodiment according to the invention, during the orientation step, every other single product is turned such that all single products are aligned in a same orientation. Alternatively, the two parts of the cut products may follow separate mass-flows of cut products. Accordingly, one of these mass-flows may be turned, for example by doing a 180 degree turn along the mass-flow transport direction. In the packer, the single products are preferably packed directly into packs of multiple products, for example twenty products. By the orientation step, all single products are oriented to have a same orientation when being packed.

According to another aspect of the method according to the invention, the method further comprises the step of detecting an interruption of the manufacturing process. If the interruption of the manufacturing process is detected in the cutting device or downstream of the cutting device, the semi-finished products are transferred from the tipping apparatus into an expandable buffer section, thereby filling the expandable buffer section. If the interruption of the manufacturing process is detected in the tipping apparatus or upstream of the tipping apparatus, the double-length semi-finished products are transported from the expandable buffer section to the cutting device, thereby emptying the buffer. In other words, filling the buffer means that the buffer has a higher input rate than output rate of semi-finished products. Accordingly, emptying the expandable buffer section is understood as having higher output rate than input rate of semi-finished products. If semi-finished products are transported through the buffer at constant rate, no filling or emptying in the sense of building a temporary stock of semi-finished products or cut down a temporary stock of semi-finished products occurs.

A double-length semi-finished product requires at least one cutting step for producing the single product. The double-length semi-finished product has twice the length of a single product. The double-length semi-finished product may require several process steps to produce a single and final product, such as including but not limited to cutting, wrapping, orienting (turning) or a combination of several or all of these process steps. The single product may be a consumer god, such as an aerosol-generating product for use in an aerosol-generating device.

The term "substantially cylindrical" semi-finished product or segments is used herein to describe semi-finished products or segments having a substantially constant cross section along their length and includes, for example, cylinders having a circular or oval cross section. The semi-finished products and segments may for example be rod-shaped having a circular or oval cross section.

According to another aspect of the method according to the invention, a distal portion of the single product and a proximal portion of the single product have different diameters due to a tipping paper being wrapped around the proximal portion of the single product. The different diameters describe a stacking angle by which a distal end of the single product may be tilted with respect to a horizontal plane the single product is laid onto. Such a stacking angle may be in a range between 0.08 degree and 0.35 degree, preferably in a range between 0.09 degree and 0.30 degree, for example larger than 0.12 degree.

According to an example, each single product comprises an aerosol-generating substrate, a mouthpiece, and a tipping wrapper securing the mouthpiece to a downstream end of the aerosol-generating substrate. In such embodiments, the tipping wrapper has an upstream edge extending around the aerosol-generating substrate and a downstream edge extending around a downstream end of the mouthpiece. Preferably, the distance between an upstream end of the aerosol-generating substrate and the upstream edge of the tipping wrapper is less than about 40 mm, preferably less than about 30 mm. As described above, the present invention can reduce the overall stacking angle effect created in a stack of aerosol-generating products each comprising a step change in their outer diameter created by the tipping wrapper. The reduction in the stacking angle effect provided by the present invention is particularly significant for aerosol-generating products having a relatively short length.

As a result of the reduction in the stacking angle effect provided by the present invention, the method according to the present invention can accommodate aerosol-generating products each comprising a tipping wrapper having a thickness preferably between 0.04 mm and 0.06 mm. Preferably, a thickness of a tipping wrapper is smaller or equal to 0.06 mm and larger or equal to 0.04 mm.

It has to be noted that a step change and the resulting stacking angle is dependent on the position the single products lie on top of each other. In general, a tipping paper is wrapped in one layer. However, a seam, where the tipping paper overlaps has a double thickness. When wrapped around the outside of a mouthpiece and an aerosol-generating substrate to form an aerosol-generating product, the overlap at the seam in the tipping wrapper in combination with the tipping wrapper on the opposite side of the aerosol-generating article gives rise to a maximum step change in the outer diameter of the aerosol-generating article of double the thickness of the tipping wrapper. Therefore, in those embodiments in which the tipping wrapper has a thickness of between about 0.04 mm and about 0.06 mm, the outer diameter of the aerosol-generating article has a maximum step change at the upstream edge of the tipping wrapper of between about 0.08 mm and about 0.12 mm. When calculating the stacking angle of the entire aerosol-generating article, the upper and lower step change has to be taken into account, such an average step size and an according stacking angle corresponds to about (depending on the orientation of the seam) two to three times the single tipping paper thickness.

The reduction in the stacking angle effect also has a positive effect on aerosol-generating products comprising a high density aerosol-generating substrate, which shifts the center of mass of each aerosol-generating single product further away from the tipping wrapper and towards the aerosol-generating substrate when compared to a conventional filter cigarette.

According to an aspect of the method according to the invention, a distance between a center of mass of the single product and a midpoint along a length of the single products is preferably between about 5 percent and 20 percent of a total length of the single product, more preferably between about 7 percent and 15 percent, most preferably between about 10 percent of the total length of the aerosol-generating article and about 15 percent of the total length of the aerosol-generating article.

According to an aspect of the method according to the invention, a segment in the semi-finished product is at least one of an aerosol-forming substrate, an aerosol-cooling segment, a support element and a mouthpiece. According to another aspect of the method according to the invention, the semi-finished products comprise sequences of aerosol-forming substrate, support element, aerosol-cooling segment and mouthpiece. Preferably, the aerosol-forming substrate is a tobacco containing substrate. Preferably, the support element is a hollow acetate tube and has the function of an expansion chamber for the aerosol generated in the aerosol-forming substrate. Preferably, the aerosol-cooling segment is made of a crimped or of a gathered or of a crimped and gathered polylactic acid sheet. In the sequences, the support element is arranged between the aerosol-forming substrate and the aerosol-cooling segment. The sequences may be supplemented by further segments. Preferably, such further segments are also arranged between the aerosol-forming substrate and the aerosol-cooling segment.

As used herein, the term 'gathered' is used to describe a sheet that is convoluted, folded, or otherwise compressed or constricted substantially transversely to the longitudinal axis of the aerosol-generating article.

In a preferred embodiment, the aerosol-generating substrate comprises a gathered textured sheet of homogenised tobacco material.

As used herein, the term 'textured sheet' denotes a sheet that has been crimped, embossed, debossed, perforated or otherwise deformed. The aerosol-generating substrate may comprise a gathered textured sheet of homogenised tobacco material comprising a plurality of spaced-apart indentations, protrusions, perforations or a combination thereof.

As used herein, the term 'crimped sheet' denotes a sheet having a plurality of substantially parallel ridges or corrugations. Preferably, the substantially parallel ridges or corrugations extend along or parallel to the longitudinal axis of the semi-finished product. This advantageously facilitates gathering of the crimped sheet of homogenised tobacco material to form the aerosol-generating substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled.

The term "segment" is used to refer to an element of the semi-finished product with defined boundaries. The individual segments may have a longitudinal extension, which is larger than a radial extension. Preferably, the segments have a substantially circular cross section. Preferably, the segments of the semi-finished product have at least one of a different flexibility, a different hardness, a different compressibility, a different weight, a different shape, a different length, a different construction, different material properties, a different resistance to draw or different filtration properties. The segments of the semi-finished product may for example be cuttable or uncuttable. Preferably, a non-uniform characteristic of the semi-finished product is found along a length of the semi-finished product or along a length of one or several segments. For example a non-uniform firmness may be present in a filter element made of filter tow containing a capsule. Segments may for example have a concentric or non-concentric arrangement. Preferably, segments of an assembly of segments are made of or contain different materials such as for example carbonaceous or ceramic material, cardboard material, paper material, metals, filter tow, polylactic acid, tobacco or tobacco containing material, plant leaf material or combinations thereof. A segment may have a length, which is equal to or is a multiple of the length of a plug. Wherein, a 'plug' is the single-length segment as in the final product.

In aerosol-generating semi-finished product, generally segments of different compressibility are used. A semi-finished product may comprise rigid segments that may be arranged next to ductile segments. Some segments should not be compressed or pushed hard in order not to be scratched, deformed or otherwise inadvertently be damaged. Such segments may for example be rigid segments or plastically deformable segments.

Preferably, at least one segment is a rigid segment. A rigid segment preferably has a compressibility higher than about 10 Newton per 1.5 mm and preferably, less than about 100 Newton per 1.5 mm. Preferably, the compressibility of at least one of the segments is between about 20 Newton per 1.5 mm and about 100 Newton per 1.5 mm and more preferably between about 50 Newton per 1.5 mm and about 100 Newton per 1.5 mm.

In some embodiments the rigid segment is brittle and will not compress at all, for example a ceramic or carbonaceous segment, but the segment will instead shatter. In such an embodiment the compressibility is substantially infinite as the segment will rather break than compress.

A rigid segment is basically non-compressible or non-flexible upon compression in comparison to at least partly flexible segments such as for example segments containing aerosol-generating substrate or filter elements made of filter tow.

A rigid segment may for example be a heat source, for example a combustible heat source. The heat source may be a carbonaceous or carbon-based heat source, that is, a carbon containing heat source or a heat source comprised primarily of carbon, for example having a carbon content of at least 50 percent by dry weight. The length of a heat source segment may be about 6 mm to about 15 mm, preferably 10 mm to about 12 mm. An external diameter of a heat source segment may be between about 5 mm and about 12 mm, for example 7 mm.

A rigid segment may for example be a support element, for example in the form of a hollow tube. The tube may comprise or be made of cellulose acetate or cardboard or both. The length of a support element may be about 5 mm to about 12 mm, for example 8 mm. An external diameter of a support element segment may be between about 5 mm and about 12 mm, for example between about 5 mm and about 10 mm or between about 6 mm and about 8 mm, for example 7 mm.

Preferably, at least one segment is a compressible segment. Preferably, at least one segment of the semi-finished product is a compressible segment. A compressible segment may for example be an aerosol-cooling segment or an aerosol-forming substrate.

In some embodiments the compressibility of a segment is not monotonous, for example in a filter segment that comprises a capsule that is dispersed in the filtration material. In such a case, the segment is at first easily compressible as long as the filtration material is compressed, for example acetate tow. Then, the compressibility is reduced when the capsule is reached. Then, after the capsule breaks, the compressibility is increased again.

Depending on the manufacturing method of the aerosol-generating semi-finished product, segments may be comprised in the semi-finished product in their final (single) length or may be comprised in the stream of segments having twice the length of the single segment in the single product. Preferably, aerosol-cooling segments are comprised in the semi-finished product as double-length segments.

An aerosol-forming substrate is a substrate capable of releasing volatile compounds that can form an aerosol. Volatile compounds may be released by heating or combusting the aerosol-forming substrate. As an alternative to heating or combustion, in some cases volatile compounds may be released by a chemical reaction or by a mechanical stimulus, such as ultrasound. An aerosol-forming substrate may be solid or liquid or comprise both solid and liquid components. An aerosol-forming substrate may be adsorbed, coated, impregnated or otherwise loaded onto a carrier or support. An aerosol-forming substrate may comprise plant-based material, for example a homogenised plant-based material. The plant-based material may comprise tobacco, for example homogenised tobacco material. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise at least one aerosol-former. The aerosol-forming substrate may comprise nicotine and other additives and ingredients, such as flavourants. Preferably, the aerosol-forming substrate is a tobacco sheet such as a cast leaf tobacco. Cast leaf tobacco is a form of reconstituted tobacco that is formed from a slurry including tobacco particles, fiber particles, aerosol formers, flavors, and binders. Tobacco particles may be of the form of a tobacco dust having a particle size preferably in the order between about 30-80 μm and about 100-250 μm, depending on the desired sheet thickness and casting gap. Fiber particles may include tobacco stem materials, stalks or other tobacco plant material, and other cellulose-based fibers, such as wood fibers having a low lignin content. Fiber particles may be selected based on the desire to produce a sufficient tensile strength for the cast leaf versus a low inclusion rate, for example, a rate between approximately 2 percent to 15 percent. Alternatively or additionally, fibers, such as vegetable fibers, may be used either with the above fibers or in the alternative, including hemp and bamboo.

Aerosol-forming substrates comprising gathered sheets of homogenised tobacco for use in aerosol-generating articles may be made by methods known in the art, for example the methods disclosed in the international patent application WO 2012/164009 A2.

Aerosol formers may be added to the slurry that forms the cast leaf tobacco. Functionally, the aerosol former should be capable of vaporizing within the temperature range at which the cast leaf tobacco is intended to be used in the tobacco product, and facilitates conveying nicotine or flavour or both nicotine and flavour, in an aerosol when the aerosol former is heated above its vaporization temperature. The aerosol former is preferably chosen based on its ability to remain chemically stable and essentially stationary in the cast leaf tobacco at or around room temperature, but which is able to vaporize at a higher temperature, for example, between 40 degree to 450 degree Celsius.

As used herein, the term aerosol refers to a colloid comprising solid or liquid particles and a gaseous phase. An aerosol may be a solid aerosol consisting of solid particles and a gaseous phase or a liquid aerosol consisting of liquid particles and a gaseous phase. An aerosol may comprise both solid and liquid particles in a gaseous phase. As used herein both gas and vapour are considered to be gaseous.

The aerosol aerosol-generating substrate may have an aerosol former content of between about 5 percent and about 30 percent on a dry weight basis. In a preferred embodiment, the aerosol-generating substrate has an aerosol former content of approximately 20 percent on a dry weight basis.

Preferably, the aerosol former is polar and is capable of functioning as a humectant, which can help maintain moisture within a desirable range in the cast leaf tobacco. Preferably, a humectant content in the cast leaf tobacco is in a range between 15 percent and 35 percent.

Aerosol formers may be selected from the polyols, glycol ethers, polyol ester, esters, fatty acids and monohydric alcohols, such as menthol and may comprise one or more of the following compounds: polyhydric alcohols, such as propylene glycol; glycerin, erythritol, 1,3-butylene glycol, tetraethylene glycol, triethylene glycol, triethyl citrate, propylene carbonate, ethyl laurate, triacetin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

The length of an aerosol-forming substrate segment may be between about 5 mm to about 16 mm, preferably between about 8 mm to about 14 mm, for example 12 mm. Accordingly, a double-length aerosol-forming substrate preferably has a length of between about 16 mm and 32 mm, preferably 24 mm. An external diameter of an aerosol-forming substrate may be at least 5 mm and may be between about 5 mm and about 12 mm, for example between about 5 mm and about 10 mm or of between about 6 mm and about 8 mm. In a preferred embodiment, the aerosol-generating substrate has an external diameter of 7.2 mm plus or minus 10 percent.

Tobacco cast leaf is preferably crimped, gathered and/or folded to form a rod-shaped segment. The cast leaf material tends to be tacky and be plastically deformable. If pressure is exerted onto the cast leaf segment, the segment tends to irreversibly deviate from its intended, for example circular, shape.

An aerosol-cooling segment may be a component of an aerosol-generating semi-finished product and is in the final product located downstream of the aerosol-forming substrate. In use, an aerosol formed by volatile compounds released from the aerosol-forming substrate passes through the aerosol-cooling segment. The aerosol is cooled therein through contact with the cooling material. An aerosol-cooling segment is preferably positioned between an aerosol-forming substrate and a mouthpiece. Preferably, an aerosol-cooling segment has a large surface area, but causes a low pressure drop. Filters and other mouthpieces that produce a high pressure drop, for example filters formed from bundles of fibers, are not considered to be aerosol-cooling segments. Chambers and cavities such as expansion chambers and support elements are also not considered to be aerosol-cooling segments. An aerosol-cooling segment preferably has a porosity in a longitudinal direction of greater than 50 percent. The airflow path through the aerosol-cooling element is preferably relatively uninhibited. An aerosol-cooling segment may be a gathered sheet or a crimped and gathered sheet. An aerosol-cooling segment may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil or any combination thereof. An aerosol-cooling segment preferably comprises a sheet of PLA, more preferably a crimped, gathered sheet of PLA. An aerosol-cooling segment may be formed from a sheet having a thickness of between about 10 μm and about 250 μm, for example about 50 μm. An aerosol-cooling segment may be formed from a gathered sheet having a width of between about 150 mm and about 250 mm. An aerosol-cooling segment may have a specific surface area of between about 300 $mm^2$ per mm length and about 1000 $mm^2$ per mm length or between about 10 $mm^2$ per mg and about 100 $mm^2$ per mg weight. In some embodiments, the aerosol-cooling element may be formed from a gathered sheet of material having a specific surface area of about 35 $mm^2$ per mg.

An aerosol-cooling segment may have an external diameter of between about 5 mm and about 10 mm, for example about 7 mm. An aerosol-cooling segment in a single product, an aerosol-cooling plug, may have a length of between about 7 mm and about 28 mm, for example about 18 mm. Accordingly, a double-length aerosol-cooling segment preferably has a length of between about 14 mm and 56 mm, preferably 36 mm. An external diameter of an aerosol-cooling segment may be between about 5 mm and about 12 mm, for example 7 mm.

The compressibility of a segment can be measured in a compression test in which the segment is placed on a substantially flat support surface and a force is applied in a downwards direction on one side of the segment using a head having a flat, 12 mm round surface moving at a speed of 100 mm per minute. A suitable apparatus for conducting such a test is the FMT-310 Force Tester of Alluris GmbH. Prior to testing, the segment is conditioned for 24 hours at a temperature of 22 degree Celsius and a relative humidity of 55 percent before the compression test is carried out. The test is continued until the insert has been compressed 1.5 mm. The force (Newton) at this point is the compressibility. If the test is unable to continue to 1.5 mm compression, the force can be normalized to 1.5 mm. In other words, if the maximum compressive force is 28 Newton and the compression at this maximum compression is 1.4 mm, the reported value for compressibility will be 30 Newton per 1.5 mm (28 Newton divided by 1.4 multiplied by 1.5).

A segment of the semi-finished product may be a mouthpiece. A mouthpiece is the last segment in the downstream direction of the aerosol-generating article or aerosol-generating device. The consumer contacts the mouthpiece in order to pass an aerosol generated by the aerosol-generating article or aerosol-generating device though the mouthpiece to the consumer. Thus, a mouthpiece is arranged downstream of an aerosol-forming substrate. A mouthpiece may comprise a filter. A filter may have low particulate filtration efficiency or very low particulate filtration efficiency. A filter may be located at the downstream end of the aerosol-generating article. A filter may be longitudinally spaced apart from the aerosol-forming substrate. A filter may be a cellulose acetate filter plug.

The mouthpiece may have an external diameter of between about 5 mm and about 10 mm, for example of between about 6 mm and about 8 mm. In a preferred embodiment, the mouthpiece has an external diameter of 7.2 mm plus-minus 10 percent. The mouthpiece may have a length of between about 5 mm and about 20 mm. preferably a length of between about 5 mm and about 14 mm. In a preferred embodiment, the mouthpiece has a length of approximately 7 mm.

The aerosol-generating substrate and any other segment upstream of the mouthpiece, such as a support element and an aerosol-cooling segment, are circumscribed by an outer wrapper. The outer wrapper may be formed from any suitable material or combination of materials. Preferably, the outer wrapper is a cigarette paper.

The single product may have a total length of between about 40 mm and about 50 mm, for example about 45 mm. A segment of the semi-finished product may also be a void or a cavity arranged between two consecutive segments. Therein, a void is the absence of material that forms a cavity when being wrapped with a piece of wrapping material. Cavities or voids may for example serve to help expand an aerosol in the aerosol-generating semi-finished product or to adapt a length of an aerosol-generating semi-finished product to a desired length of the final product. With a cavity or void this may be done without or without noticeably limiting a resistance to draw (RTD) of the aerosol-generating article.

According to another aspect of the invention there is provided an apparatus for intermediately storing double-length substantially cylindrical semi-finished products. The apparatus comprises a tipping apparatus for forming double-length substantially cylindrical semi-finished products. The apparatus further comprises a cutting device for cutting the double-length semi-finished products into single products and a packer for packing the single products. The apparatus yet further comprises a transport system for transporting the double-length semi-finished products from the tipping apparatus to the cutting device and the single products from the cutting device to the packer. In the apparatus, a buffer is arranged between the tipping apparatus and the cutting device for intermediately storing double-length substantially cylindrical semi-finished products.

According to an aspect of the apparatus according to the invention, a transport distance between the cutting device and the packer is less than about 50 percent, preferably less than about 30 percent, for example about 15 percent of the total transport distance between the tipping apparatus and the packer. A total transport distance is measured from the location where the double-length semi-finished products leave the tipping apparatus until the single products enter the packer.

Preferably, cutting the double-length semi-finished products into single products is performed immediately upstream and before packing the single products. By this, the single products do not have to be transported over a long distance before being packed.

According to another embodiment of the apparatus according to the invention, the buffer is a mass-flow buffer system for double-length semi-finished products. In a mass-flow system, the semi-finished products follow a main transport direction but need not necessarily have a same predetermined motion path. The semi-finished products need not exactly be aligned with each other. Preferably, in the mass-flow buffer system, several semi-finished products are arranged above each other forming a stack that extends into the transport direction of the semi-finished products.

According to a further aspect of the apparatus according to the invention, the buffer has a capacity corresponding to a production capacity of the apparatus of about 5 minutes to 30 minutes, preferably of about 10 minutes to 20 minutes, for example about 15 minutes. A buffer may for example also have a capacity to buffer at least 10,000 double-length semi-finished products, preferably at least 50,000 double-length semi-finished products, for example more than 100,000 double-length semi-finished products. According to needs, a buffer capacity may be adapted to absolute amounts of products to be buffered or to a relative number corresponding to a time to make due for reduced or interrupted input or output into or out of the buffer.

A capacity of the buffer may be defined by a length of a conveyor band adapted to transport double-length semi-finished products, for example stacks of semi-finished products. According to an aspect of the apparatus according to the invention, the buffer comprises a conveyor band for transporting double-length semi-finished products arranged on the conveyor band and support guides for guiding sections of the conveyor band to different levels arranged above each other. Arranging a conveyor band over different levels, for example in a spiraling manner, buffering space may be used efficiently. In addition, buffer capacity may be extended or limited, for example, by providing additional layers.

A buffer may for example be a buffer system as described in U.S. Pat. No. 6,422,380 adapted to the transport and buffering of semi-finished products. In the input station of the buffer system, semi-finished products are received that have been transported by the transport system from the tipping apparatus to the input station. Accordingly, in the output station of the buffer system, semi-finished products are collected from the buffer and are transported by the transport system from the buffer to the cutting device. In between the input station and output station, a capacity of the buffer may be adapted according to need. For example, by increasing the height of semi-finished products in the mass-flow or by varying a distance between input and output station a buffer capacity may be altered. However, semi-finished products are rod shaped and do not have a tipping step, thus that the stacking angle problem does not exist in the U.S. Pat. No. 6,422,380.

According to another aspect of the apparatus according to the invention, the apparatus further comprises a control device for online controlling double-length semi-finished products. A control device may be provided for controlling the manufacturing process or for example for controlling the quality of the product or both process and quality of the manufacturing.

A controlling of the manufacturing process may for example be a control of presence or absence of products or product components. A control of the quality of the product may for example include visual appearance of the product or internal specifications such as for example density, moisture content or a resistance to draw measurement (RTD) of the double-length semi-finished product. Such control measurements may be performed online. In general, for example an RTD for a double product is different from the RTD of an end product. However, generally a target range for the RTD of a semi-finished product is defined. A product will pass the control if the RTD of the product is within this target range. A RTD measurement or any other control measurement may identify a defective product. This product may be removed from the transport system and thus from the apparatus according to the invention. The RTD measurement may be performed before the semi-finished products enter the buffer or before the semi-finished products are cut in the cutting device. A RTD measurement performed before the semi-finished products are fed into the buffer may safe buffer capacity, since defective products may be removed from the process before being stored in the buffer. A RTD measurement performed after the double-length semi-finished products have left the buffer may be used for removal of products from the process that have negatively been affected in the buffer system.

Further aspects and advantages of the apparatus have been described relating to the method according to the invention and will not be repeated here.

Preferably, the method and apparatus according to the invention as described herein are used in the production of aerosol-generating articles.

The invention is further described with regard to embodiments, which are illustrated by means of the following drawings, wherein FIG. 1 schematically shows a manufacturing process with buffer system;

Figure 5:
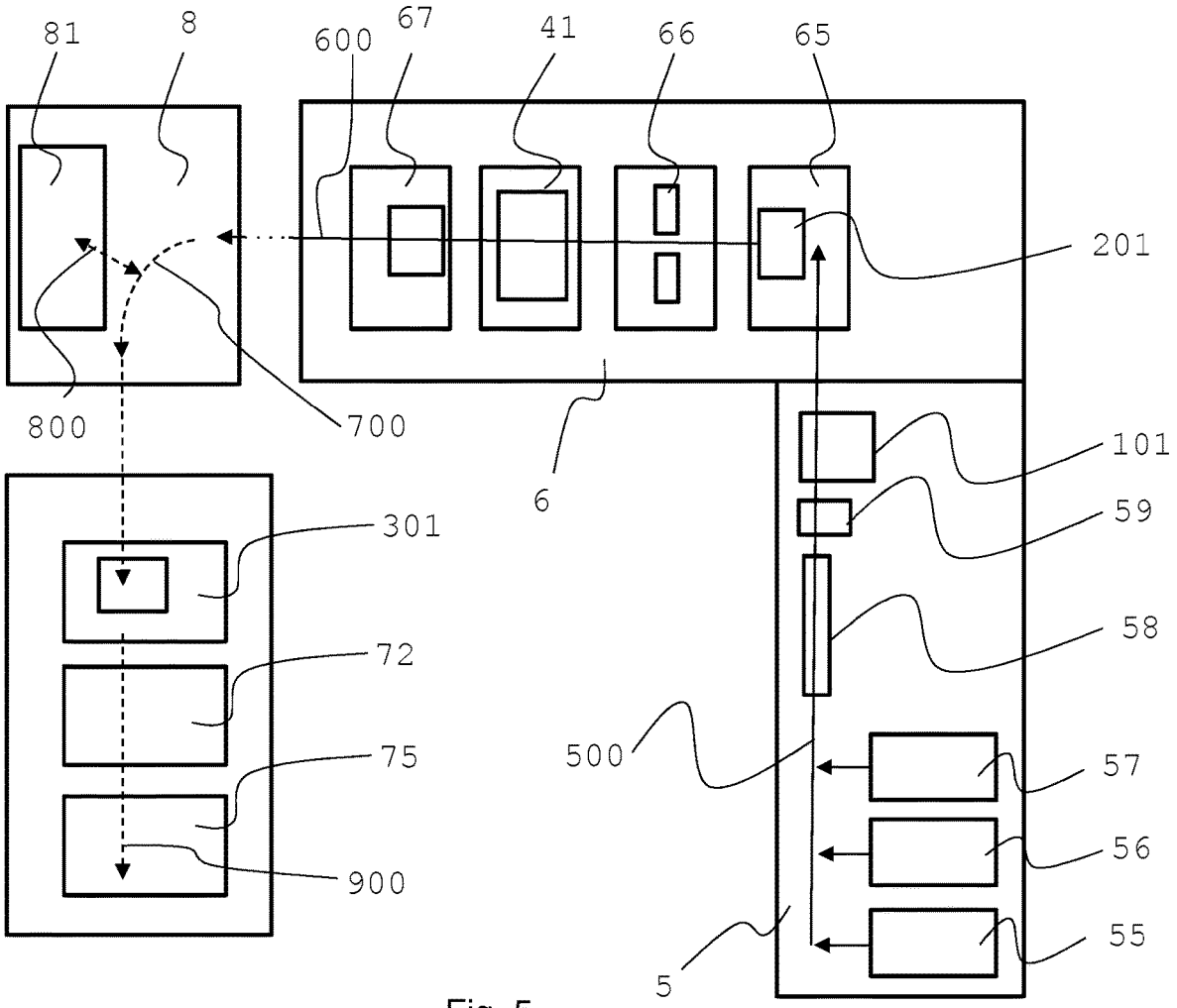
Figure 6:
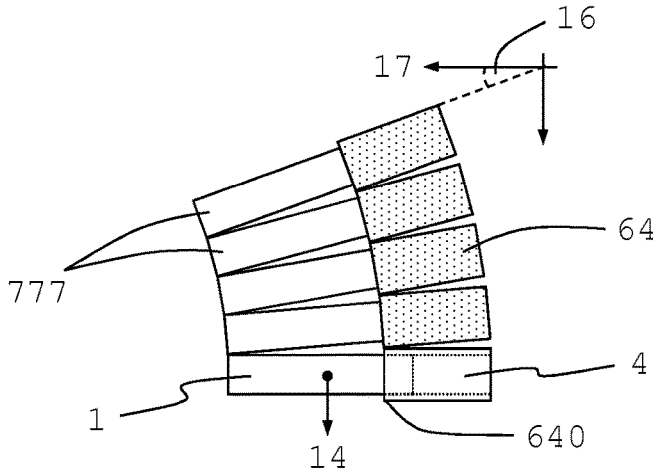

FIG. 5 schematically shows another embodiment of a manufacturing process;

FIG. 6 schematically shows the stacking angle problem of single products.

Figure 1:
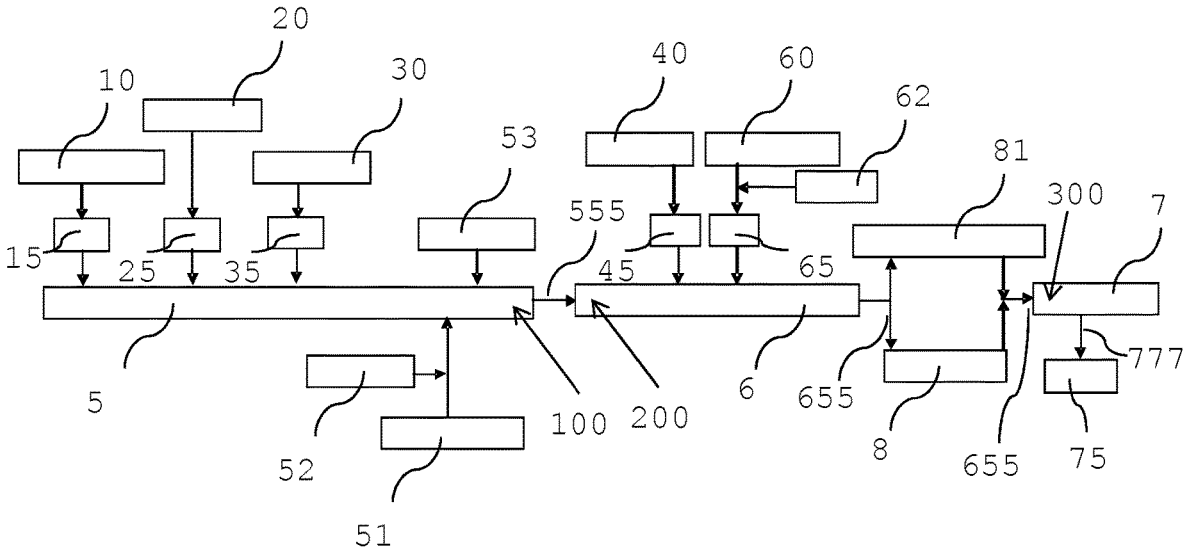

In FIG. 1 a manufacturing process of semi-finished products in the form of double-products in a tipping apparatus, which tipping apparatus 6 comprises a combiner 5 adjacently arranged to and upstream of the tipping apparatus 6 is shown. The double products 655 are transported from the tipping apparatus 6 to the buffer 8 and from there to the cutting device 7 followed by the packer 75.

First rod 10, second rod 20 and third rod 30 of materials used in the manufacture of aerosol-generating articles are supplied and cut with respective cutting devices 15,25,35. The so cut first, second and third segments are supplied in an end-to-end relationship on a longitudinal motion path in the combiner 5.

Figure 2:
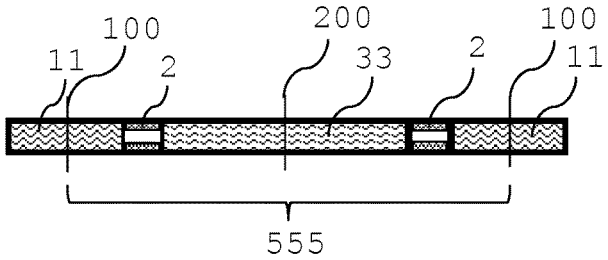
FIG. 2 shows a section of a rod of segments manufactured in a combiner.
Figure 3:
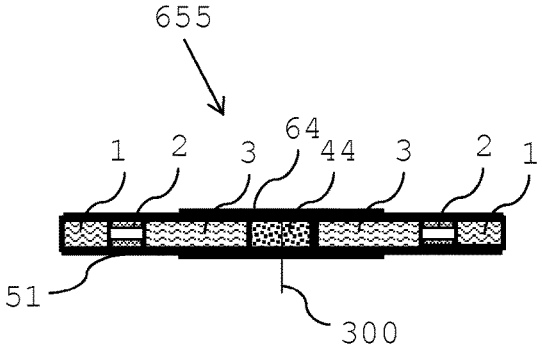
FIG. 3 shows a double product manufactured in an apparatus according to the invention.
Figure 4:
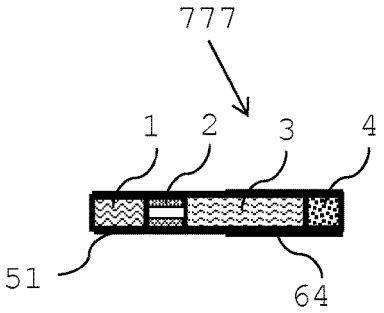
FIG. 4 shows the single product manufactured from the double product as shown in FIG. 4.

In the embodiment shown in FIGS. 2 to 4, first and third rod 10, 30 are cut to double segments 11,33 having a length twice the length of the final plugs 1,3 before being fed to the longitudinal motion path in the combiner 5. Second rod 20 is cut to single segments 2 directly having the length of the plug 2 in the single product 777 before being fed to the longitudinal motion path.

The segments 11,2,33 form a stream of segments, the axis of the segments being arranged parallel to the longitudinal motion path. A sheet of wrapping material 51, for example cigarette paper, is provided with an adhesive with glue provider 52. The sheet of wrapping material 51 is supplied to and guided along the longitudinal motion path in the combiner 5. The stream of segment is wrapped with the wrapping material 51, for example in a respective garniture provided along the longitudinal motion path. An addition glue provider 53 adds a seam of glue to the wrapping material 51 before the wrapping material is entirely wrapped around the stream of segments. The so formed rod of segments is now cut at the end of the longitudinal motion path in the combiner 5. Thereto, a rod cutting device is provided (not shown) that cuts the rod of segments by cutting the first segment 11 at cutting line 100 (see FIG. 2). The first segment 11 is cut in half such that the two cut parts of the first segments correspond to plugs 1. By this cutting of the endless rod wrapped segment rods 555 are manufactured, which are further processed in the tipping apparatus 6 before being transported to the buffer 8. Plugs 1 each form end segments of the wrapped segment rods 555. The wrapped segment rods 555 are now transferred from the longitudinal motion path in the combiner 5 to a perpendicular motion path in the tipping apparatus 6.

This may be done by moving the wrapped segment rods further along the longitudinal motion path 500, for example with a linear movement, into flutes of a fluted receiving drum in the tipping apparatus. Therein, a longitudinal axis of the flute is aligned with the longitudinal first motion path. A transfer from the combiner into flutes of a receiving drum may also be performed by a spider mechanism, for example, as described in U.S. Pat. No. 5,327,803 for cigarettes. A wrapped segment rods is then gripped by a spider arm from the combiner and transferred by the spider arm into a flute of the receiving drum in the tipping apparatus.

Since the axis of the segments substantially keep their orientation while being processed in the combiner and in the tipping apparatus, the axis of the segments are parallel to the moving direction of the longitudinal motion path of the combiner 5 but perpendicular to the moving direction of the perpendicular motion path of the tipping apparatus 6. Preferably, the tipping apparatus 6 is arranged perpendicular to the combiner 5 such that the respective motion paths are also perpendicular to each other. By this, the axis of the segments are always oriented in a same direction.

In the tipping apparatus 6 the wrapped segment rods 555 are divided by cutting the second segment 33 at cutting line 200. Thereby, the second segment 33 is cut in half such that the two cut parts of the segments correspond to plugs 3. The so cut wrapped segment rods 555 is separated by a separating device (not shown) along the longitudinal axis of the wrapped segment rods 555. In the space between to so cut and separated pre wrapped segment rods 555 a fourth segment 44 is inserted. The fourth segment is also a double-length segment and is cut in a respective cutting device 45 from a fourth rod 40 supplied to the tipping apparatus 6. A continuous sheet of tipping paper 60 is provided and cut in cutting device 65 to individual tipping wrapper pieces 64. The piece of tipping wrapper 64 is wrapped around the fourth segment 44 as well as around portions of the two parts of the cut pre wrapped segment rods 555. Thus, these elements are combined with each other forming a double product 655 as shown in FIG. 3. This double product is now transported to buffer 8 for intermediate storing of the double product 655. When required, the double product 655 leaves the buffer 8 and is transported to the cutting device 7. There, the double product 655 is cut in half by cutting the fourth segment 44 at cutting line 300. By this, two single and final products 777 as shown in FIG. 4 are manufactured. Each other single product may then be turned such that all products have a same orientation. The so aligned and oriented products are transported to the packer 75 for packing the products, for example directly into smoking article packs. A tray 81 may additionally be provided parallel to the buffer 8. On the tray 81 double-products may be collected either for (long-time) storage and future use or as overflow to extend the capacity of the buffer 8. Accordingly, the transport system or the buffer 8 have means for branching off excess double products.

In FIG. 5 a manufacturing process for single products is shown in an arrangement of combiner 5 and tipping apparatus 6, where combiner 5 and tipping apparatus 6 are arranged adjacent and perpendicular to each other. The straight longitudinal motion path 500 in the combiner 5 and the perpendicular motion path 600 in the tipping apparatus 6 are also arranged perpendicular to each other. The perpendicular motion path 600 starts where the longitudinal motion path 500 ends. The combiner 5 comprises three hoppers 55,56,57 for feeding three different segments in alternating manner to the longitudinal motion path 500 to form a stream of segments. The stream of segments is then wrapped in the wrapper 58 forming an endless rod of segments. The endless rod of segments is controlled in controller 59 and then cut into wrapped segment rods by rod cutting device 101. Preferably, the rod cutting device 101 is a rotating knife arranged next to the longitudinal motion path 500. The controller 59 may be provided for controlling a position of the segments in the endless rod of segments. For example to determine an exact position where the rod has to be cut, for example to secure that the rod is cut exactly between segments or at a position dividing a segment into smaller segments. The wrapped segment rods are then transferred each into a flute of a fluted receiving drum 65 of the tipping device 6. The longitudinal motion path 500 is a substantially straight path, where the segments or the stream of segments, respectively, are guided along in a substantially straight line. The first motion path 500 extends into the fluted receiving drum 65 of the tipping apparatus. Preferably, the longitudinal motion path is arranged parallel to a flute of the fluted receiving drum 65, such that a wrapped segment rod cut by rod cutting device 101 may be transferred with a continuing straight movement into a flute of the fluted receiving drum longitudinally along the longitudinal motion path.

The wrapped segment rod is then cut on the fluted receiving drum 65 by product cutting device 201, for example comprising a rotating knife. The two parts of the cut wrapped segment rod are then separated while being arranged in flutes of separating drum 66. Hopper 41 inserts an additional segment, preferably a segment different to the segments of the endless rod of segments, in between the two parts of the cut wrapped segment rod. Preferably, the additional segment is a double-length mouthpiece. The two parts of the cut wrapped segment rods and the inserted additional segment are tipped on tipper 67 with a tipping material, for example a piece of paper. The so combined segments form a double product. At the end of tipping apparatus 6 the double products formed are transported to the buffer 8. From the buffer 8 the double products are transferred to a final cutting device 301, where the double product is cut into two single products. In the subsequently arranged turning device 72, each other single product is turned by 180 degrees or one part of the mass-flow is guided by a 180 degree turn along the transport direction, in order for all single products to have a same orientation. So oriented single products are then transferred to and packed in packer 75.

In the combiner and in the tipping apparatus including the transfer from the combiner to the tipping device, the wrapped segment rods and double products are processed according to an individual product flow. In an individual product flow, control over an individual product is given at any stage in the manufacturing and processing line. For example, the position and alignment of the product is known at any time. In buffer 8 the products are buffered and transported according to a mass-flow 700. In a mass-flow the products are transported in and along a general moving direction. Thus an exact position of the individual products in the mass-flow is not known. The buffer 8 comprises an expandable buffer section 81 that may accommodate changes in the mass flow, for example when either of the upstream or downstream machines the process speed changes, for example for maintenance. During that time, the expandable buffer section 81 is filled or emptied along the transport path 800. The mass flow 700 through the buffer 8 ends at the final cutting device 301. After the cutting device, in the turning device 75 and after the turning, the aligned single products are again transported according to a mass-flow 900 to a reservoir of the packer 75. There, the single products are preferably collected in the reservoir for being supplied to packer 75. In FIG. 5, the individual product flows are indicated by solid lines and the mass-flows are indicated by dotted lines.

FIG. 6 shows a side view of part of the stack of aerosol-generating articles such as the single products 777 shown in FIG. 4. Each single product 777 comprises an aerosol-generating substrate 1 secured to a mouthpiece 4 by a tipping wrapper 64. The thickness of the tipping wrapper 64 has been exaggerated to more clearly illustrate the step change in the outer diameter of each single product 777 at the upstream edge 640 of the tipping wrapper 64. As a result of the center of mass 14 of each single product 777 being positioned upstream of the tipping wrapper 64, each single product 777 lies at an angle with respect to the underlying single product 777 on which it sits. Although each individual angle is relatively small, the angles between consecutive pairs of single product 777 provide a cumulative effect such that a significant stacking angle 16 with respect to the horizontal direction 17 is formed at the top of the stack. Over the total height of the entire stack for example in a vertical stacking channel the stacking angle 16 can be large enough to cause the single product 777 at the top of the stack to tip into a vertical orientation, which can cause jams for example in a buffer, particularly at the bottom of a buffer or hopper where the single product 777 reach individual feeding channels.

Basically, the risk of jamming of products is limited to a transport of products in a mass-flow. However, due to the buffering of double products in a mass-flow buffer 8, the risk of jamming products is avoided or kept at a minimum in the entire manufacturing line. Single products are kept in a mass-flow after the cutting device or possibly in a reservoir of the packer only, before being packed. However, since the amount of single products in a packer reservoir is low, the risk of jamming single products therein is minimal.

Exemplary data for the process and product as described in FIGS. 1 to 4 are:

Tobacco rod 10 having a length of 120 mm is cut into double segments 11 of 24 mm length. The double-length segments 11 are then cut into final plugs 1 of 12 mm length.

Hollow acetate tube rod 20 having a length of 96 mm is cut into plugs 2 of 8 mm length.

Rod 30 of gathered polylactic acid sheet having a length of 144 mm is cut into double segments 33 of 36 mm length. The double-length segments 33 are then cut into final plugs 3 of 18 mm length.

Filter rod 40 is cut into double-length segments 44 of 14 mm length. The double-length segments 44 are then cut into final plugs 4 of 7 mm length.

The length of the semi-finished product 555 is 76 mm. The length of the double product 66 is 90 mm. The final product 77 has a length of 45 mm with a tolerance of less than plus or minus 1 mm, preferable less or equal to plus or minus 0.5 mm. The diameter of the final products is about 7.2 mm.

The final product is made of a series of tobacco plug 1, hollow acetate tube 2, plug of gathered polylactic acid (PLA) 3 and mouthpiece plug 4. A tipping wrapper 64 has a length of 20 mm and covers the entire length of the mouthpiece plug 4 and part of the PLA plug 3.

A production speed for the semi-finished product 555 may be about 5000 per minute at a movement speed of the stream of segments along the longitudinal motion path of 380 meters per minute. A production speed of the double product 655 may also be about 5000 per minute such that about 10,000 final products 777 may be produced per minute.

The invention claimed is:

1. Method for intermediately storing double-length substantially cylindrical semi-finished products, the method comprising the steps of:

providing a tipping apparatus and forming double-length substantially cylindrical semi-finished products in the tipping apparatus;

providing a cutting device and cutting the double-length semi-finished product into single products with the cutting device, wherein the single products have a length between 40mm and 50 mm and are unbalanced single products when seen over the length of the single products;

providing a packer and packing single products having the length between 40mm and 50 mm in the packer;

transporting the double-length semi-finished products from the tipping apparatus to the cutting device to cut the double-length semi-finished products into the unbalanced single products and thereafter transporting the single products from the cutting device to the packer, and intermediately buffering double-length substantially cylindrical semi-finished products in a buffer arranged between the tipping apparatus and the cutting device.

2. Method according to claim 1, wherein the step of packing single products directly follows the step of cutting the double-length semi-finished products.

3. Method according to claim 1, further comprising the steps of detecting an interruption of the manufacturing process in the cutting device or downstream of the cutting device, and transporting the double-length semi-finished products from the tipping apparatus into an expandable buffer section, thereby at least partially filling the expandable buffer section.

4. Method according to claim 3, further comprising the step of emptying the expandable buffer section towards the cutting device, thereby at least partially emptying the expandable buffer section.

5. Method according to claim 1, wherein a segment in the double-length semi-finished product is at least one of an aerosol-forming substrate, an aerosol-cooling segment, a support element and a mouthpiece.

6. Method according to claim 1, wherein the double-length semi-finished products comprise sequences of aerosol-forming substrate, support element, aerosol-cooling segment and mouthpiece, wherein the support element is arranged between the aerosol-forming substrate and the aerosol-cooling segment.

7. Method according to claim 1, wherein a distance between a center of mass of the single product and a midpoint along the length of the single products is between about 5 percent and 20 percent of a total length of the single product.

8. Method according to claim 1, wherein a distal portion of the single product and a proximal portion of the single product have different diameters due to a tipping paper being wrapped around the proximal portion of the single product, and wherein the different diameters describe a stacking angle by which a distal end may be tilted with respect to a horizontal plane the single product is laid onto, and wherein the stacking angle is in a range between 0.08 degree and 0.35 degree.

9. Method according to claim 1, wherein the step of packing single products directly follows the step of cutting the double-length semi-finished products, and being separated only by a step of orienting the single products in a same orientation.

10. Method according to claim 2, further comprising the steps of detecting an interruption of the manufacturing process in the cutting device or downstream of the cutting device, and transporting the double-length semi-finished products from the tipping apparatus into an expandable buffer section, thereby at least partially filling the expandable buffer section.

11. Method according to claim 1, wherein a distal portion of the single product and a proximal portion of the single product have different diameters due to a tipping paper being wrapped around the proximal portion of the single product, and wherein the different diameters describe a stacking angle by which a distal end may be tilted with respect to a horizontal plane the single product is laid onto, and wherein the stacking angle is in a range between 0.09 degree and 0.30 degree.

12. Method according to claim 4, wherein a segment in the double-length semi-finished product is at least one of an aerosol-forming substrate, an aerosol-cooling segment, a support element and a mouthpiece.

13. Method according to claim 1, wherein the single products have an uneven mass distribution.

14. Method according to claim 1, wherein a segment in the double-length semi-finished product is an aerosol-forming substrate, and the method further providing a tipping wrapper in the tipping apparatus, wherein a distance between an upstream end of the aerosol-generating substrate and an upstream edge of the tipping wrapper is less than about 40 mm.

15. Method according to claim 1, wherein a segment in the double-length semi-finished product is an aerosol-forming substrate, and the method further providing a tipping wrapper in the tipping apparatus, wherein a distance between an upstream end of the aerosol-generating substrate and an upstream edge of the tipping wrapper is less than about 30 mm.

* * * * *